United States Patent [19]

Cop et al.

[11] Patent Number: 4,744,860

[45] Date of Patent: May 17, 1988

[54] PROCESS FOR MAKING A NON-POLAR POLYMERIC MATERIAL DYEABLE WITH AN ACID DYE

[75] Inventors: Leopold Cop, Burlington, Canada; Jan Jordaan, De Rijp, Netherlands; Henry P. Schreiber; Michael R. Wertheimer, both of Montreal, Canada

[73] Assignee: Shell Oil Company, Houston, Tex.

[21] Appl. No.: 38,174

[22] Filed: Apr. 14, 1987

[30] Foreign Application Priority Data

Apr. 14, 1986 [GB] United Kingdom ..... 8609071

[51] Int. Cl.[4] ..... B44C 1/22; B29C 37/00

[52] U.S. Cl. ..... 156/643; 8/115.52; 8/115.65; 8/149.2; 8/928; 8/930; 8/DIG. 12; 156/646; 156/651; 156/668; 156/272.6; 204/168; 204/192.36; 252/79.1; 427/40; 427/307

[58] Field of Search ..... 156/643, 646, 651, 654, 156/655, 668, 272.2, 272.6–275.7, 277; 252/79.1, 40, 41; 427/307, 197; 8/115.51, 115.52, 115.54–115.56, 115.65, 149.2, 928–930, DIG. 12; 204/165, 168, 192.36

[56] References Cited

U.S. PATENT DOCUMENTS

| | | | |
|---|---|---|---|
| 3,387,991 | 6/1968 | Erchak et al. | 204/168 X |
| 3,870,610 | 3/1975 | Baird et al. | 204/165 |
| 4,576,692 | 3/1986 | Fukuta et al. | 204/165 |

*Primary Examiner*—William A. Powell

*Attorney, Agent, or Firm*—Wendy K. B. Buskop

[57] ABSTRACT

Process for treating at least one surface of a non-polar polymeric material to improve the receptivity of that surface to coloration with an acid dye, which comprises treating said surface of the material with a low temperature microwave plasma from a chemical compound which is capable of creating receptor sites for acid dye on said surface.

20 Claims, No Drawings

PROCESS FOR MAKING A NON-POLAR POLYMERIC MATERIAL DYEABLE WITH AN ACID DYE

BACKGROUND OF THE INVENTION

The present invention relates to a process for making a non-polar polymer material dyeable with an acid dye.

From Canadian Pat. No. 972,429 which relates to a plasma generator using microwave energy, it is known that desirable characteristics can be imparted to various materials such as plastics, via a plasma treatament. For example, "cross-linking" a desirable characteristic for certain plastic materials can be achieved on the surface of such a material when exposed to a gaseous plasma. Crosslinking a plastic film, such as a polyethylene film, can greatly improve bonding and printing characteristics of the film. It is also possible to graft various molecules to free radical sites created by plasma treatment on polymeric fibers. Through crosslinking, the dyeability and washability characteristics of certain textiles, e.g. polyester and other synthetic materials, can be greatly improved. Exposure to a plasma also has been found to substantially reduce shrinkage to natural fibers, such as wool. Certain organic vapors in a plasma can be made to form solid polymer films on a substrate passed through the plasma. By this method, a layer of very thin polymer can be made which is free of defects, which is useful for various industrial purposes, such as, encapsulation of electronic components or protection of surfaces against corrosion.

Using plasma, the bonding characteristics of films or fibers prepared from natural or synthetic polymeric materials or combinations thereof can be improved. It is possible to form protective oxide or nitride layers on the surfaces of metals or semiconductors, to synthesize useful organic or inorganic molecules, and to obtain laser action by an especially developed process. Details of these processes, familiar to those skilled in the art, are not given here. The "Large Volume Microwave Plasma Generator" (LMP) described in Canadian Pat. No. 972,429 is capable of efficiently producing atoms and other chemically active species which can be highly advantageous in the above processes.

It is an object of the present invention to modify the surface of a non-polar polymeric material by low temperature microwave plasma in order to render that material dyeable with conventional acid dyes.

In constrast to other fiber materials such as wool, silk, nylon, cellulose and polyester, non-polar polymeric materials, such as polypropylene, are not receptive to acid dyes. Traditionally, polypropylene in fiber manufacture has been colored by mass pigmentation. This coloring technique provides good color wear resistance but has the disadvantage of expensive pigment costs and high inventory costs. Also, the use of massive amounts of pigments on the non-polar polymeric fibers harms certain intrinsic fiber properties, such as uniformity in the fibers which outweighs the color wear resistance advantage. For these reasons, development efforts have been directed towards making non-polar materials such as polypropylene, receptive to acid dyes.

It has now been found that non-polar polymeric material can be made receptive to acid dyes by treating the surface of the non-polar polymeric material with a low temperature microwave plasma generated in an LMP microwave plasma generator, in which a chemical compound has been introduced. The subsequently generated plasma is capable of creating receptor sites for acid dye on the surface of the non-polar polymeric material. The chemical compound useful in this novel method will be referred to hereinafter as the "plasma monomer".

Of great importance is the finding that the LMP treatment of a polypropylene fiber or fabric, either woven or non-woven, fiber or cloth, is sufficiently penetrant to all regions of the fiber or cloth such that cross-over regions are equally affected by the treatment, but can retain, unaffected, the mechanical and thermal properties of the fiber and/or fabric.

SUMMARY OF THE INVENTION

The present invention provides a process for making a surface of a non-polar polymeric material receptive to coloration with an acid dye. The novel process comprises treating the non-polar polymeric surface with a low temperature microwave plasma wherein a chemical compound has been added, thereby creating receptor sites for acid dye on the surface of the non-polar polymeric material.

This invention includes an article, the non-polar polymeric material, which is receptive to coloration with an acid dye.

The invention includes a method wherein a non-polar polymeric material is treated with a low temperature microwave plasma which radiates from a chemical compound selected from the group consisting of hexamethylene diamine, allyamine, formamide, butylamine, acrylamine, ammonia, hydrazine, 1,3-diaminopropane, pyrrolidine, heptamine, acrylic acid, touidine, acetonitrile, vinyl pyridine and acrylamide.

DETAILED DESCRIPTION OF THE INVENTION

The present invention provides a process for treating at least one surface of a non-polar polymeric material to improve the receptivity of that surface to coloration with an acid dye which comprises treating the surface of the material with a low temperature microwave plasma from a chemical compound which is capable of creating receptor sites for acid dye on that surface.

Suitable chemical compounds useful within the scope of the novel process include compounds containing N-H (nitrogen and hydrogen) groups. It is believed that certain compounds containing N-H groups when exposed to a microwave plasma, can modify the plasma to treat the non-polar surface and form N-H groups containing acid dye receptor sites on the surface of the non-polar polymeric material. Preferably an N-H group containing chemical compounds is selected from the group consisting of hexamethylene diamine (HDMA), allyamine, formamide, butylamine, acrylamine, ammonia, hydrazine, 1,3-diaminopropane (DAP), pyrrolidine, heptamine, acrylic acid, toluidine, acetonitrile, vinyl pyridine and acrylamide. The compound 1,3-diaminopropane (DAP) is most preferred for use with the present invention since this compound achieves excellent dyeability of the non-polar polymeric material with acid dyes.

Polypropylene is a preferred non-polar polymeric material to be used within the scope of the present invention. Other polyolefinic materials may be used within the scope of the invention.

The non-polar polymeric material can be in the form of fibers, either woven or non-woven or fabrics and cloths either woven or non-woven.

It has further been found that pre-etching the surface of the non-polar polymeric material improves the dyeability of the material. Pre-etching of the material provides improved crocking resistance for the subsequently dyed fiber or fabric. "Crocking resistance" is commonly thought of as resistance against loss of dye by abrasion and other tribological forces.

Suitable etching means to accomplish pre-etching of the material, can be performed in a variety of ways. A carona spark discharge using an overall potential difference of 6 kV or 8 kV for up to 10 minutes or an Argon plasma can be suitable pre-etching means. A preferred pre-etching means can be with the Argon plasma using 50–150 watts at 0.5 torr pressure, for short periods of time such as between 0.5 and 10 minutes. This type of Argon pre-etching of the non-polar polymeric material can be accomplished in 2 to 8 minute intervals as well. Crocking resistance of the non-polar material is also considerably improved if the microwave plasma is generated at a power level of more than 600 watts, though lower levels may be used. It appears that a maximum degree of dyeability is obtained when power levels are between about 400 and about 700 watts.

Crocking resistance of the non-polar polymeric material can be improved by further treating the dyed material with an air plasma at elevated temperatures, above room temperature. Preferably this secondary conditioning of the dyed non-polar polymeric material which may or may not be pre-etched is carried out in air plasma at a temperature in the range of about 75° C. to about 125° C. If polypropylene is used as the non-polar polymeric material, then the preferred air temperature for this air plasma treatment is about 100° C.

The dyed non-polar polymeric material can be alternatively conditioned by submersing the polymeric material in a boiling solution, at a temperature above 100° C. This submersion treatment of the material, with or without pre-etching and/or air plasma treatment enhances the polymer's resistance against loss of dye during abrasion. It is preferred to boil the fabric or fiber in a detergent solution for this supplemental treatment.

The present invention will now be further described with reference to the following examples.

EXAMPLE 1

Five different amines, ammonia (1), allyamine (2), heptylamine (3) diaminohexane (4) and 1, (3)-diaminopropene were evaluated as the plasma monomer for use within the scope of the present invention.

In each case as designed and constructed by the Assignees of Canadian Pat. No. 972429 type microwave plasma generator was used. The operating conditions of the microwave plasma generator reactor were chosen and adjusted such that a highly uniform glow discharge was obtained. These operating conditions varied from experiment to experiment within the following ranges:

| | |
|---|---|
| monomer pressures | from about 0.2 to about 0.8 torr |
| power | from about 150 to about 300 watts |
| substrate temperature | from about 80° C. to about 100° C. |

Samples of polypropylene staple fiber (0.5 grams per sample) were pre-etched, and then exposed to the plasma treatment for periods of time ranging from about 5 to about 300 seconds. After plasma treatment, the samples were either immediately dyed or alternatively, stored from two days to two weeks and then dyed.

In order to achieve the increased surface concentration of acid dye-receptor sites on the fiber samples, and to produce irregularities (hollows and micropores) on the surface of each sample, samples were pre-etched, as noted above, by exposure to a carona spark discharge using an overall potential difference of 6 kV or 8 kV for up to 10 minutes or alternatively by exposure to an Argon plasma. In this experiment, Argon etching was performed at 0.5 torr pressure, 50–150 watts, for periods from 0.5 to 10 minutes.

For the dyeing procedure, acid dye baths with dye concentrations in the range of 0.05% by 1.0% by weight of fiber were used at 50° C. (±2° C. ), and at a pH of 4.5. The pH of the acid dye baths was controlled by carefully monitored additions of acetic acid. Although numerous acid dyes were used, the bulk of the experiments were carried out with 0.1% by weight solutions of blue dyes Nylomine B - 3 G and A - GS, both dyes being available on the market.

The polypropylene samples were immersed in the acid dye bath for periods of time ranging from 10 to 800 seconds. In some experiments, the fiber samples were immersed in at least one dye solution. Generally, dyed fibers were removed from the acid dye bath, washed in a dilute aqueous solution of urea, and then rinsed twice in warm water at a temperature between 30° C. and 90° C., preferably about 50° C., prior to further evaluation. In some situations, the fibers were dyed in more than one acid dye bath.

Dye uptake was characterized qualitatively by visual comparison. The crocking resistance was estimated by judging the intensity of color transferred from the fiber to a standard white sheet upon rubbing the fiber vigorously against the sheet for 30 seconds. Optical microscopy was employed to study the surfaces of the pre-etched fibers.

In order to assess the effects of the various treatments on the mechanical and physical properties of the fibers the stress-strain behavior was determined on an Instron tensiometer and the melting points were determined on a Perkin-Elmer Differential Scanning Calorimeter (DSC). The stress/strain behavior was tested on 0.1 g bundles of fiber, cut to uniform length (2 inches) with a jaw separation speed of 0.5 cm/s. The crystalline melting points were determined on the DSC by heating 150 mg fiber samples at a constant rate of 5° C./min. to 200° C.

TABLE 1

| SAMPLE* | 0 | 1 | 2 | 3 | 4 | 5 |
|---|---|---|---|---|---|---|
| Dye uptake** | 0 | 2 | 2 | 2 | 2–3 | 3 |
| | Dye uptake** | | | | | |
| Sample 5, | 0 | 1 | 2 | 3 | 4 | 5 |
| Plasma Treatment time, sec. | — | 5 | 30 | 60 | 180 | 300 |
| Dye immersion time, sec | 10 | 30 | 60 | 120 | 300 | 900 |
| Interval between plasma treatment and dyeing, days | 0.05 | 1 | — | 5 | — | 14 |
| Dye concentration, | — | 0.01 | 0.1 | — | 0.5 | 1.0 |

TABLE 1-continued

| SAMPLE* | 0 | 1 | 2 | 3 | 4 | 5 |
|---|---|---|---|---|---|---|
| % w | | | | | | |

*the number of the respective samples corresponds with the five different amines tested.
**Visual ratings: dye-uptake
5 very intense color development
4 intense color development
3 average color development
2 light color development
1 ultralight color development
0 no color development Based on these fiber experiments it has been determined that:

all the amines evaluated enhanced acid dyeability of the fibers, diaminopropane treated surfaces exhibit the highest degree of dye-uptake, the degree of dye uptake is related to the plasma treatment time, the plasma treated polypropylene fibers are receptive to a number of different acid dye colors, color intensity of dye-uptake can be regulated by varying the dye immersion time, the plasma treatment appears to be permanent, as dye uptake does not vary over time, i.e., by varying interval times, up to 14 days, between plasma treatment and dyeing the dye uptake appeared constant, color intensity is found to be a function of dye concentration, intense color development is possible with a color concentration of 0.01% (by weight of fiber) and etching pre-treatments appear to have no visual effects on dye uptake, that is dying appears uniform over the surface between the etched and non-etched portions of the material.

In summary, the experiments showed, that LMP treatments enhance acid dyeability of a non-polar polymeric material.

EXAMPLE 2

Polypropylene woven cloth samples such as those commerically available from Celanese, were treated in monomer plasma from each member of the following group:

hexamethylene diamine (5), formamide (7), butylamine (8), acyrlamine (9), hydrazine (10), pyrrolidine (11), heptamine (12), acrylic acid (13), toluidine (14), acetonitrile (15), vinylpyrroline (16), acylamide (17), acronitrile (18), ethanol (19), and methanol (20).

Following the plasma treatments samples were conditioned in air at room temperature, for several minutes and then dyed in a laboratory autoclave with a commercially available acid blue dye. The dye was 1 1% aqueous solution used in proportions of 30 ml dye solution per gram of polypropylene woven cloth substrate. All dyed polypropylene woven cloth specimens were first rinsed at least 4 times in a hot (80° C.) detergent solution, and subsequently in hot (80° C.) water. Further evaluation of the dyed samples was carried out analogously to the methods as described in Example 1.

A number of hydrophilic monomers were evaluated applying standard LMP treatment conditions, but with power levels of 400 watts power, and pressures of about 0.2 torr with a 120 second exposure time. Pressures of for example between 0.1 torr and 0.4 torr also can be used within the scope of the invention although they were not used in this experiment. Like the pressure, the exposure times can be varied within the scope of the invention such as between 10 and 300 seconds.

The results of the evaluations indicate that strongly basic monomers such as amines hexamethylene diamine, acrylamine, hydrazine, acrylic acid and 1,3-diaminopropane produce very satisfactory dyeability. Amphoteric, weakly acid or weakly basic monomers, such as the alcohols, and amines formamide, butylamine, ammonia, heptamine, toluidine, acetonitrile and vinylpyrroline are less effective. The amine 1,3-diaminopropane proved to be the most effective monomer of this sample.

LMP technology offers a technique for uniformly depositing a layer of plasma product of as yet unspecified chemical nature (depending on the plasma monomer(s) used) onto the surface of a non-polar polymeric material such as a polypropylene fiber, a woven fabric, or a non-woven fabric to enhance its dyeability with acid dyes.

What is claimed is:

1. A process for treating at least one surface of a non-polar polymeric material to improve the receptivity of that surface to coloration with an acid dye, which comprises treating said surface of the material with a low temperature microwave plasma from a chemical compound which is capable of creating receptor sites for acid dye on said surface.

2. The process of claim 1, wherein said process involves treating a polyolefinic non-polar polymeric material.

3. The process of claim 2, wherein said non-polar polymeric material is polypropylene material.

4. The process of claim 1, wherein the non-polar polymeric material consists of a member of the group comprising: woven fibers, non-woven fibers, woven fabric and non-woven fabric.

5. The process of claim 1, wherein said chemical compound is selected from the group consisting of hexamethylene diamine, allyamine, formamide, butylamine, acrylamine, ammonia, hydrazine, 1,3-diamino propane, pyrrolidine, heptamine, acrylic acid, toluidine, acetonitrile, vinyl pyridine and acrylamide.

6. The process of claim 1, wherein the surface of the non-polar polymeric material is pre-etched.

7. The process of claim 1, further comprising using a power level of between about 50 and about 600 watts for the low temperature microwave plasma.

8. The process of claim 1, further comprising the step of treating said non-polar polymeric material with an air plasma after treating the non-polar material with said low temperature microwave plasma from said chemical compound.

9. The process of claim 8 wherein said air plasma is heated to a temperature in the range of between about 75° C. and about 125° C.

10. The process of claim 1, wherein said low temperature of the microwave plasma is between about 30° C. and 100° C.

11. The process of claim 1, further comprising the step of treating said non-polar polymeric material by boiling it after dying in a detergent solution at a temperature of about 100° C.

12. A process for treating at least one surface of a non-polar polymeric material to improve the receptivity of that surface to an acid dye comprising:

pre-etching the surface of a non-polar polymeric material;

exposing said pre-etched material to a low temperature microwave plasma from a chemical monomer selected from the group consisting of hexamethylene diamine, allyamine, formamide, butylamine, acrylamine, ammonia, hydrazine, 1,3-diaminopropane, pyrrolidine, heptamine, acrylic acid, toluidine, acetonitrile, vinyl pyridine and acrylamide at between 0.1 torr pressure and 0.4 torr pressure, using about 50 to about 600 watts for about 10 to about 300 seconds;

immersing the treated material in at least one acid dye bath with said bath heated to a temperature in the range of about 48° C. to about 52° C. for a period of time ranging between 10 and 800 seconds.

13. The process of claim 12, wherein said non-polar polymeric material is a polyolefin.

14. The process of claim 13, wherein said polyolefin is polypropylene.

15. The process of claim 12, wherein said non-polar polymeric material is a member of the group consisting of non-woven fibers, woven fibers, non-woven fabrics and woven fabrics.

16. The process of claim 12, wherein said acid dye bath consists of acetic acid and a blue dye.

17. The process of claim 16, wherein said blue dye is nylomine.

18. The process of claim 12, further comprising the step of washing the material that has been dyed with at least one dilute aqueous solution of urea and then further rinsing the dyed material in an aqueous solution comprising a detergent and heated to a temperature between about 30 ° C. and about 90° C.

19. The process of claim 18, wherein said detergent solution is heated to a temperature between 70° C. and 90° C.

20. The process of claim 12, further comprising the step of treating the dyed material with an air plasma which has been heated to a temperature in the range of between about 75° C. and about 125° C.

* * * * *